United States Patent [19]

Carr

[11] 4,351,111

[45] Sep. 28, 1982

[54] MACHINE TOOL FOR SCRIBING ARCS AND CIRCLES

[76] Inventor: John A. Carr, R.D. #5, Box 524, Hanover, Pa. 17331

[21] Appl. No.: 241,421

[22] Filed: Mar. 6, 1981

[51] Int. Cl.[3] ..... B26D 3/08

[52] U.S. Cl. ..... 30/164.9; 30/310

[58] Field of Search ..... 30/164.9, 300, 310; 33/27 C, 27 D

[56] References Cited

U.S. PATENT DOCUMENTS

| | | | |
|---|---|---|---|
| 520,246 | 5/1894 | Sinsz | 30/164.9 |
| 1,791,648 | 2/1931 | Tate . | |
| 2,269,510 | 1/1942 | Bates | 30/310 |
| 2,512,235 | 6/1950 | Lankford | 33/27 C |
| 2,546,292 | 3/1951 | Bell | 30/310 X |
| 2,546,292 | 3/1951 | Bell | 30/310 |
| 2,778,108 | 1/1957 | Welsh | 30/300 |
| 2,795,277 | 6/1957 | Wortham . | |
| 2,943,392 | 7/1960 | Attridge | 30/310 |
| 4,044,464 | 8/1977 | Schiess et al. | 30/164.9 |

FOREIGN PATENT DOCUMENTS

| | | | |
|---|---|---|---|
| 732473 | 9/1932 | France | 30/164.9 |

*Primary Examiner*—Jimmy C. Peters
*Attorney, Agent, or Firm*—C. Hercus Just

[57] ABSTRACT

A machine tool for scribing arcs and circles on work pieces comprising an elongated arm having a vertical stud adjacent one end for mounting in a chuck on a rotary spindle, a slide having a plurality of scribing styluses of different sizes disposed at an angle to each other and extending perpendicularly from the outer surface, the slide being movable along the arm to dispose the styluses selectively at desired precise distances from the stud and the slide also being rotatable on the arm to position one of the styluses in parallelism with the stud, a clamping thumb screw threaded into the slide for engagement with the arm to releasably secure the slide to arm at a selected position thereon, slide having a notch extending into the face nearest stud and adapted to receive the same when very small radii are desired, and a fixed reference flange on the stud end of arm positioned outwardly from the axis of stud a distance equal to the distance between the axis of the stylus on slide and the face of the slide nearest stud to permit gauge blocks to be inserted between flange and face of slide to precisely equal the distance between the axes of stud and stylus.

7 Claims, 5 Drawing Figures

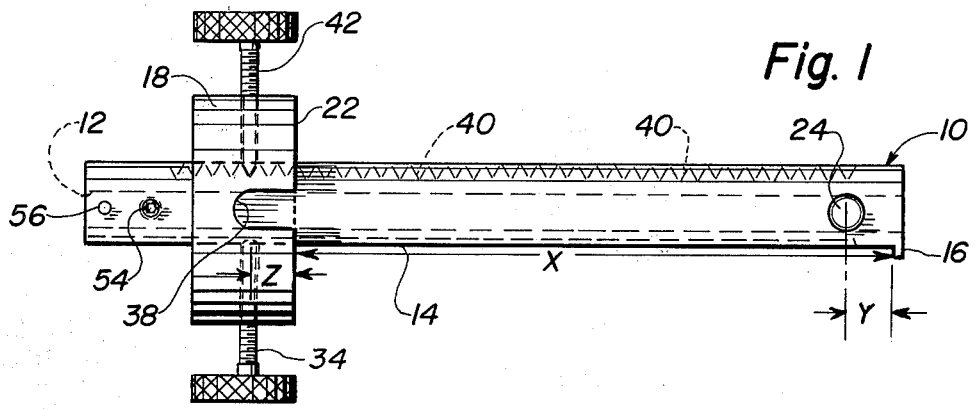
Fig. 1
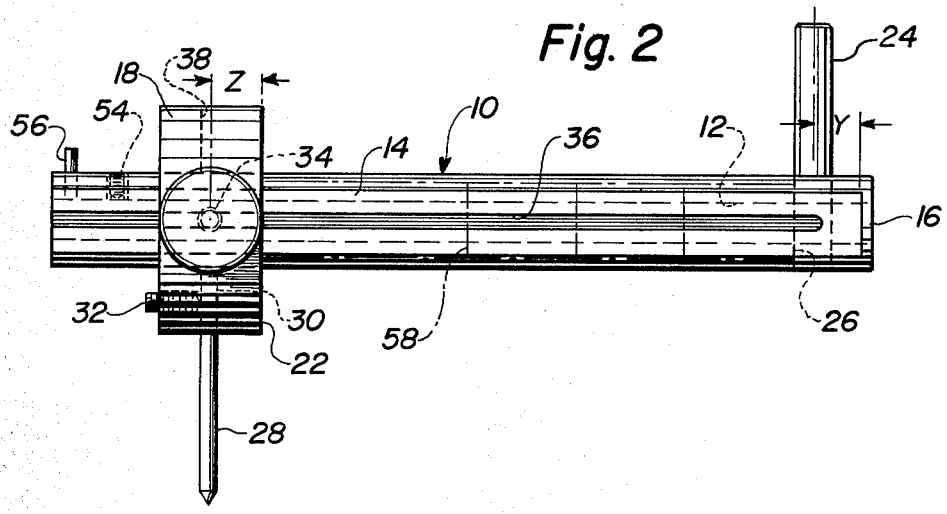
Fig. 2
Fig. 3
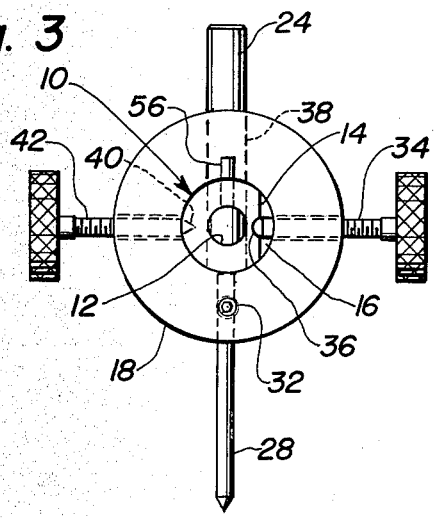
Fig. 4
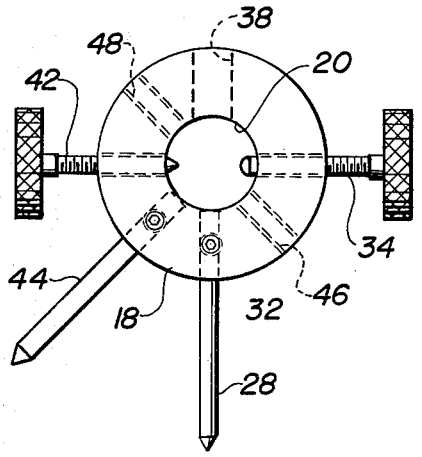
Fig. 5
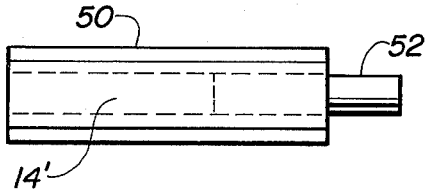

MACHINE TOOL FOR SCRIBING ARCS AND CIRCLES

BACKGROUND OF THE INVENTION

Scribing arcs and circles upon work pieces, such as sheet material and the like by accurate means, has been a problem confronting machinists and other types of metal workers and the like for many years. Related to the problem is the cutting of discs or flat annular type of devices or items formed from various types of material, including metal. The cutting of curved surfaces on glass also presents related problems.

In attempts to solve some of these problems, tools comprising a central pivot adapted to be placed stationarily upon a sheet of material to be cut and provided with an arm having one end connected to the pivot and the opposite end having a cutting tool of some sort thereon are disclosed in the following patents, which are representative of this type of tool:

| | | |
|---|---|---|
| U.S. Pat. No. 520,247 | Sinsz | May 22, 1894 |
| U.S. Pat. No. 1,791,648 | Tate | Feb. 10, 1931 |
| U.S. Pat. No. 2,269,510 | Bates | Jan. 13, 1942 |
| U.S. Pat. No. 4,044,464 | Schiess et al | Aug. 30, 1977 |

The cutting of circular holes also heretofore has employed tools similar to the foregoing with the exception that a scriber has been included on the horizontal bar in addition to the cutter and such a device is the subject matter of prior U.S. Pat. No. 2,795,277 to Wortham, dated June 11, 1957.

A cutting tool operable about a vertical axis and having a horizontal arm which supports a pair of cutters also has been devised heretofore and is the subject of prior U.S. Pat. No. 2,546,292 to Bell, dated Mar. 27, 1951.

For drafting purposes, instruments known as beam compasses have been employed for many years, some of which even include the feature of adding extensions to the horizontal bar upon which the drafting marker is carried with respect to a stationary pivot placed in the drawing. A typical device of this type is illustrated in prior U.S. Pat. No. 2,512,235 to Lankford, dated June 20, 1950.

The foregoing patents are merely illustrative and exemplary of a very substantial number of tools for making circular cuts, scribing or drawing circular lines and the like. For machine work, however, it is frequently necessary to be extremely accurate with respect to the arc or circle to be drawn upon a work piece, and on occasions, even the matter of a few thousandths of an inch is critical. To determine the radius length to such precise dimensions, resort to the use of accurate gauge blocks of well-known machine type is required, and the present invention provides a scribing tool with which gauge blocks readily may be employed to determine the desired radii of a very precise nature. The structures shown in the prior U.S. patents referred to above have no such means for utilizing gauge blocks to arrive at a desired very precise radius of either a cutting or drafting tool.

SUMMARY OF THE INVENTION

It is among the principal objects of the invention to provide a machine tool for scribing arcs and circles on work pieces, including an elongated arm, having a vertical stud adjacent one end for mounting the same in a chuck on a rotary spindle, said arm having a slide provided with at least one scribing stylus and extending perpendicularly from the outer surface thereof in parallelism with said stud, said slide being movable along the arm to dispose the stylus selectively at a desired precise distance from the axis of the stud, and said arm adjacent said stud being provided with a fixed reference flange positioned outwardly from the axis of the stud a distance equal to that between the axis of the stylus on the slide and the face of the slide nearest said stud to permit gauge blocks to be inserted between said flange and face of said slide to precisely equal the distance between the axes of said stud and stylus.

It is another object of the invention to provide a flat face upon said arm extending longitudinally thereof from said reference flange for purposes of providing a surface upon which gauge blocks may be positioned while locating the slide at a desired precise position upon the arm.

A further object of the invention ancillary to the foregoing object is to provide along said flat surface a groove extending into the same and said slide having a thumb screw threaded radially into the slide for engagement of the inner end of the thumb screw with said groove to secure the slide at a desired position relative to the stud as determined by the use of said gauge blocks or otherwise.

Still another object of the invention is to provide along said arm in radially-spaced location with respect to said flat face upon the arm, a row of precisely-spaced indentations for indicating certain positions relative to said reference flange, and said slide having a second thumb screw threaded radially into said slide at a circumferentially-spaced location with respect to the first-mentioned thumb screw, the inner end of said second thumb screw having a configuration complementary to the shape of said indentations and received therein for purposes of securing the slide quickly at a desired location with respect to the stud when said location is equal to a given indicating indentation formed upon the arm, and thereby, providing a relatively quick means for locating the slide upon the arm when the dimension is of a type obtainable by using a selected indicating indentation.

A still further object of the invention is to provide upon said slide a plurality of styluses respectively of different diameters and disposed at a precise angle with respect to each other, said arm being cylindrical in shape and the slide also being circular and having a bore which is circular of the same diameter as said arm and slidable therealong, whereby said slide may be rotatable upon said arm to dispose a selected stylus for positioning within a vertical plane parallel to the axis of the stud and the other stylus on the sleeve extending angularly away from the selected stylus so as not to interfere with the scribing operation of the selected stylus.

Still another object of the invention is to form the arm from thick-walled tubular stock and the end thereof opposite that to which the stud is connected being open and adapted to receive a plug of complementary size fixed to one end of an extension arm adapted to be connected with the first-mentioned arm.

One further object of the invention is to provide on said slide a recess extending inward from one face thereof and being of a shape complementary to the stud and operative to receive said stud when very small radii are to be scribed by the tool.

Details of the foregoing objects and of the invention, as well as other objects thereof, are set forth in the following specification and illustrated in the accompanying drawings comprising a part thereof.

BRIEF DESCRIPTION OF THE DRAWINGS

FIG. 1 is a top plan view of the machine tool embodying the principles of the present invention.

FIG. 2 is a side elevation of the machine tool illustrated in FIG. 1.

FIG. 3 is an end view of the tool shown in FIGS. 1 and 2, as seen from the left-hand end thereof.

FIG. 4 is an end view of the slide shown in FIGS. 1–3, illustrated as being removed from the arm carrying the same in said preceding figures.

FIG. 5 is an arm extension adapted to be added to the left-hand end of the arm shown in FIGS. 1 and 2 of said tool.

DETAILED DESCRIPTION OF THE PREFERRED EMBODIMENT

Referring especially to FIGS. 1 and 2, it will be seen that the scribing tool comprising the present invention includes an elongated arm 10 which, especially as shown in FIG. 3, in the preferred embodiment, comprises a cylindrical tube having a thick wall and a central circular bore 12, but it is to be understood that said arm may be solid, if desired, but in any event, preferably, it has an outer cylindrical shape which is modified along one side by an elongated flat face 14, which extends from a perpendicular reference flange 16, the inner face of which is very precisely perpendicular with respect to the plane of the flat surface 14, the surface 14 extending continuously from the inner face of the flange 16 to the other end of the arm 10.

Slidably adjustable along arm 10 is a slide 18 which, as best shown in FIG. 4, has a central bore 20 complementary to the cylindrical portion of the arm 10 and at least the face 22 thereof is perpendicular to the axis of arm 10 and is also parallel to the inner face of the reference flange 16. Also, arm 10, slightly inward from the end upon which the flange 16 is formed, is provided with a perpendicular stud 24, which is adapted to be engaged within a chuck on a rotary spindle of an appropriate machine tool, such as drill press, milling machine, or otherwise. Not only is the stud 24 perpendicular to the axis of arm but the outer surface thereof preferably is uniformly circular in cross-section throughout the length thereof, one end of the stud being mounted within a bore 26 extending perpendicularly into arm 10 and firmly fixed therein for permanent attachment thereto. Extending radially from slide 18 is a scribing needle or point 28, which is fitted precisely into a radially drilled bore 30 and the end of the needle which extends into said bore is secured thereto by any suitable means, such as an Allen set screw 32. The distance between the precisely perpendicular axis of the scribing needle 28 and the perpendicular face 22 of slide 18 is critical in the present invention because, preferably, said distance which is indicated "Z" in FIGS. 1 and 2, is precisely equal to the distance "Y", which is between the precise axis of stud 24 and the inner face of reference flange 16. These distances, being equal to each other, render the distance between the inner face flange 16 and face 22 on slide 18 equal to the distance between the axis of stud 24 and the axis of the scribing needle 28. Referring to FIG. 1, it will be seen that the distance referred to between the faces of flange 16 and 22 of slide 18 is indicated "X".

In view of the foregoing, it is very convenient to dispose the tool with the flat face 14 uppermost and place one or more gauge blocks upon said surface in abutting relationship with each other and also in abutment between the inner face of flange 16 and parallel face 22 of slide 18 to determine a very precise dimension between the axes of stud 24 and scribing needle 28. To maintain said distance, the slide 18 is provided with a clamping thumb screw 34, the inner end of which is adapted to engage a slot 36, which extends longitudinally preferably along the flat face 14, such engagement being illustrated in FIG. 3. Either English, decimal or metric dimensions may be used, if desired.

In the event very small radii are desired to be scribed, such as those less than half the diameter of the stud 24, with reference to FIG. 1, it will be seen that the face 22 of the slide 18 has a notch 38 formed therein which preferably has an inner surface complementary to half of the stud 24 and otherwise has a width equal to the diameter of the stud 24, whereby for scribing arcs and circles of such small radii, the axis of the scribing needle 28 may be brought almost into registry with the axis of stud 24.

In the event it is desired to dispose the slide 18 with respect to the stud 24 at a distance comprising a plurality of some basic spacing, such as of the order of one-eighth inch, the arm 10 is provided preferably along the surface opposite the flat surface 14 with a row of indentations 40, as shown in FIG. 1, and one of said indentations being shown in FIG. 3. In order to clamp the slide 18 with respect to a selected indentation 40, the slide 18 is provided with a second thumb screw 42, which is threaded radially into slide 18 precisely along a transverse plane within which the axis of the first-mentioned thumb screw 34 is disposed, whereby the axis of the second thumb screw 42 is a precise dimension with respect to the face 22 of slide 18, incident to determining the distance to be effected between said face 22 and the inner face of reference flange 16, when using the row of indentations 40 for distances not requiring gauge blocks.

Referring to FIG. 4, it will be seen that a different embodiment of the slide 18 is shown from that illustrated in FIG. 3 in that a plurality of styluses are shown, stylus 28 being the same as shown in FIG. 3, but an additional stylus 44 also being mounted radially upon slide 18 at a predetermined angle between the styluses, such as of the order of forty-five degrees or any other suitable angular relationship found to be desirable. The purpose of providing a plurality of styluses is that the stylus 44, for example, may be of a larger diameter than the stylus 28, and for most work, the larger stylus 44 may be satisfactory, but for certain jobs where a small stylus is desired, such as where an obstruction on a work piece, for example, might prevent the use of the larger diameter stylus 44, whereby the smaller diameter stylus 28 would be more useful. To accomplish changing the slide 18 to dispose the selected stylus for use with the tool, it is only necessary to rotate the slide about the arm 10 after moving the locking thumb screws 34 and 42 to inoperative position and thereby dispose the selected stylus to be parallel to the stud 24, and thereby depend vertically from the arm when mounted in the machine tool with which the present invention is used.

To accomplish changing the tool from one stylus to the other, it will be seen from FIG. 4 that the slide 8 is provided with a plurality of tapped holes within which the thumb screw 34 is to be mounted so as to be at a right-angle to the selected stylus. To permit this, the slide is provided with an additional tapped hole 46 for screw 34 and, similarly, a further additional tapped hole 48 is provided in the slide 18 for the thumb screw 42, the aforementioned pairs of tapped holes respectively for the thumb screws 34 and 42 being separated by an angle equal to that which separates the plurality of scribing needles 28 and 44.

In the event the scribing tool of the present invention requires additional length, by referring to FIG. 5, it will be seen that an extension arm 50, having the same diameter and cross-sectional shape as arm 10, is formed with a desired length and includes, for example, the flat face 14', corresponding to flat face 14 on arm 10. At one end of the extension arm 50, a plug 52 is provided which is closely complementary to the central circular bore 12 of arm 10 and fits into the open end thereof, shown at the left in FIGS. 1 and 2, and to connect the same securely together, any suitable means, such as a Phillips set screw 54, is employed to engage the plug 52. If desired, as illustrated in exemplary manner in FIGS. 1 and 3, a preferably removable stop pin 56 may be inserted in the end of arm 10 opposite that which supports the reference flange 16, especially to prevent accidental separation of the slide 18 from arm 10. When the extension 50 is employed, however, it will be necessary to remove the pin 56 for operation of slide 18.

From the foregoing, it will be seen that the scribing tool comprising the present invention provides means for precisely locating the scribing needles with respect to the axis of the supporting stud 24, such as by the use of gauge blocks 58, shown in phantom in FIG. 2, especially where odd dimensions are required for such position, not capable of being obtained by the regularly spaced indentations 40, for example, but, where such high precision is not required, the indentations 40 may be employed to obtain spaces having dimensions of a plurality of the increments of space between the row of indentations 40. Further, a plurality of different sizes of scribing needles may be selectively disposed in operative position and thus, render the tool more universal than otherwise for operation upon special types of jobs.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A machine tool for scribing arcs and circles on work pieces comprising in combination, an elongated arm having a smooth outer surface of uniform cross-sectional shape, a perpendicular stud fixed to said arm a short distance inwardly from one end thereof for supporting said arm in a chuck on a rotatable spindle of a machine tool, a slide having a bore closely complementary to the surface of said arm and slidable adjustably therealong, a stylus for scribing work pieces projecting perpendicularly from said slide, means carried by said slide and engageable with said arm to releasably clamp said slide and stylus thereon at a precise distance from the axis of said stud, the width of said slide in a direction parallel to said arm being greater than the diameter of said stud, said arm having a reference flange fixed to the stud end thereof outwardly from said stud and provided with a perpendicular face spaced precisely from the axis of said stud a distance equal to the distance between the face of said slide nearest said stud and the axis of the stylus carried by said slide, whereby guage blocks may be positioned along said arm between said faces of said flange and slide to permit precise radii to be established upon said tool for scribing arcs and circles therewith.

2. The tool according to claim 1 further including a notch in the face of said slide nearest said stud complementary in shape to said stud and adapted to receive said stud to dispose the stylus on said slide at very short radii from the axis of said stud.

3. The tool according to claim 1 further having a flat face extending therealong from said reference flange toward the other end thereof and adapted to have guage blocks supported thereon when held in a horizontal position while setting said slide and stylus at a desired radial distance from the axis of said stud.

4. The tool according to claim 3 in which said flat surface has a groove extending longitudinally therealong, and said clamping means carried by said slide comprises a thumb screw threaded radially into said slide and the inner end of said thumb screw being shaped substantially complementarily to the cross-sectional shape of said groove and engageable therewith to maintain said slide at a predetermined desired position on said arm relative to said stud.

5. The machine tool according to claim 1 further characterized by said arm being cylindrical and the bore in said slide being circular for limited rotation about the axis of said arm, said slide having a plurality of styluses respectively of different diameters extending perpendicularly from the outer surface of said slide and arranged at a predetermined angle to each other, said clamping means on said slide comprising a thumb screw threaded radially through said slide into clamping contact with said arm, and said slide being cylindrical and having a plurality of threaded holes extending radially therein respectively at an identical angle to each other as the angle between said styluses, whereby said thumb screw may be threaded into the threaded hole pertaining to the stylus selected for use for engagement of the inner end of the stylus with the same longitudinal area on said arm to be engaged by said thumb screw.

6. The machine tool according to claim 1 further characterized by said stud having a diameter of predetermined precise dimension and said arm having a row of indented dimension indications of precise dimensional spacings therealong, and a first threaded thumb screw having an inner end engageable with a selected indented indication to accurately position said slide dimensionwise relative to said stud in accordance with the positions of said indications relative to the axis of said stud.

7. The machine tool according to claim 6 in which said arm has a groove extending longitudinally therealong from said reference flange and spaced circumferentially from said row of indented dimension indications, and said clamping means for said slide comprising a second thumb screw spaced from circumferentially on said slide the same distance that said row of indented indications and groove are spaced circumferentially upon said arm and adapted to secure said slide upon said arm at a desired radial distance from the axis of said stud different from a dimension corresponding to a selected indented dimension indication.

* * * * *